US007854083B1

(12) United States Patent
Aalto

(10) Patent No.: US 7,854,083 B1
(45) Date of Patent: Dec. 21, 2010

(54) CARTRIDGE MAGAZINE FOR FIREARMS

(75) Inventor: Juha Aalto, Riihimäki (FI)

(73) Assignee: Sako Oy, Riihimaki (FI)

( * ) Notice: Subject to any disclaimer, the term of this patent is extended or adjusted under 35 U.S.C. 154(b) by 522 days.

(21) Appl. No.: 11/823,846

(22) Filed: Jun. 28, 2007

(51) Int. Cl.
*F41A 9/65* (2006.01)

(52) U.S. Cl. ..... 42/50

(58) Field of Classification Search ..... 42/49.01, 42/49.1, 50; 89/195, 197, 33.1
See application file for complete search history.

(56) References Cited

U.S. PATENT DOCUMENTS 1,352,413 A * 9/1920 Payne ..... 89/145
4,586,281 A * 5/1986 Chesnut ..... 42/50
4,805,333 A * 2/1989 Doria et al. ..... 42/50
5,309,660 A * 5/1994 Blackamore ..... 42/50
5,319,871 A * 6/1994 Racheli ..... 42/50
5,561,933 A * 10/1996 Czekalski ..... 42/18
5,615,505 A * 4/1997 Vaid ..... 42/50
5,761,841 A * 6/1998 Snick ..... 42/50
7,047,686 B2 * 5/2006 Zimmermann ..... 42/75.1
2004/0020092 A1 * 2/2004 Christensen ..... 42/49.01
2004/0255503 A1 * 12/2004 Fitzpatrick ..... 42/49.01
2007/0169390 A1 * 7/2007 Bubits ..... 42/7

FOREIGN PATENT DOCUMENTS

WO WO 2007/059549 5/2007

* cited by examiner

*Primary Examiner*—Bret Hayes
(74) *Attorney, Agent, or Firm*—Alfred A. Fressola; Ware, Fressola, Van Der Sluys & Adolphson LLP

(57) ABSTRACT

A cartridge magazine for firearms has an elongated channel to receive a plurality of cartridges. The cartridge magazine has a box forming a housing of the cartridge magazine, a spring operated follower for pressing the cartridges in the magazine to an upper position. In this position, the topmost cartridge is ready for feeding into a chamber of the firearm and in this position the topmost cartridge rests against a pair of retaining lips. The lips remain in a first position when the topmost cartridge is in the upper position and the lips are operatively displaceable to a second position wider than the first position.

14 Claims, 4 Drawing Sheets

CARTRIDGE MAGAZINE FOR FIREARMS

TECHNICAL FIELD OF THE INVENTION

This invention relates to a detachable single column also known as single row cartridge magazine of a firearm.

BACKGROUND OF THE INVENTION

A single column cartridge magazine is a well-known type of cartridge magazine. There are several benefits for this particular cartridge magazine type. It is simple and reliable. The cartridge to be fed into the chamber is initially on the same vertical plane as the chamber, which means that the cartridge does not need to move sideways while feeding into the chamber. The single column magazine is also generally easier and cheaper to manufacture than a double column magazine. The width of a firearm having a double column magazine is greater than a firearm with a single column magazine. In some cases this width is a disadvantage, especially if a narrow receiver and stock is expected. Also the receiver construction is easier to design and manufacture when there is not a wide opening needed for cartridges to be loaded from the double column cartridge magazine. In those cases where extreme strength of the receiver is requested, this single column cartridge magazine allows more material on the lower part of the receiver and thus stiffer construction.

A single column cartridge magazine has a smaller cartridge capacity than a double column cartridge magazine having the same depth. In addition to this feature, a single column cartridge magazine is not preferred in all circumstances. Some users prefer to insert new cartridges to the magazine via ejection opening of the receiver when the bolt is in the open position. In a traditional version of a single column cartridge magazine this is not possible. The user must detach the magazine and load it while it is separated from the firearm. To load the cartridge magazine the user needs to press the rear of the cartridge beneath the retaining lips and push the cartridge rearwards. This is because the retaining lips of the cartridge magazine need to be designed such that a mutual distance between the retaining lips is smaller than the diameter of the cartridge case in order to function correctly. In a single column cartridge magazine the retaining lips of the cartridge magazine set the height of the topmost cartridge in relation to the frame of the cartridge magazine and the receiver of the firearm. When the bolt is moved to the closed position, the face of the bolt takes the topmost cartridge from the cartridge magazine and loads this cartridge into the chamber. So basically to remove the topmost cartridge from the cartridge magazine requires horizontal movement in a feeding direction to be released under the down-pressing contact of the retaining lips.

The single column cartridge magazine sets the cartridges in one column having a virtual vertical centerline, which centerline is also the centerline of the chamber and the barrel. Thus, there is no need for movement of a cartridge sideways during the loading. The cartridge need only be moved vertically from the position defined by the cartridge magazines retaining lips to the chamber. This elevation is normally done by a conically shaped feeding ramp, which is located at the rear end of the chamber. When the topmost cartridge is pushed to the chamber by the bolt, the first contacting end of the cartridge is the bullet and it slides along the feeding ramp and guides the cartridge into the chamber.

OBJECT OF THE INVENTION

It is an object of the present invention to provide an improved single column cartridge magazine.

It is still another object of the present invention to provide an improved single column cartridge magazine which can also be loaded when attached to the firearm.

It is still another object of the present invention to provide an improved single column cartridge magazine which is capable of guiding the topmost cartridge into the chamber.

It is still another object of the present invention to provide an improved single column cartridge magazine which cartridge is loaded into the chamber by a guiding portion of the cartridge magazine in such a way that the frusto-conical shoulder portion of the cartridge is used for guiding purposes.

SUMMARY OF THE INVENTION

The present invention overcomes the limitations of the prior art by providing an improved cartridge magazine for firearms, the cartridge magazine having an elongated channel to receive a plurality of cartridges in a single column, the cartridge magazine comprising:

a box for forming a housing of the cartridge magazine, a spring operated follower for pressing a plurality of cartridges in the cartridge magazine to an upper position in the upper position the topmost cartridge is ready for feeding into a chamber of the firearm and in the upper position the topmost cartridge rests against a pair of retaining lips, wherein the retaining lips remain in a first position when the topmost cartridge is in the upper position, and the retaining lips are operatively displaceable to a second position wider than the first position.

Thus this single column cartridge magazine comprises stiff but still bendable retaining lips. The retaining lips are formed from a stiff and shape permanent material such as steel, aluminum or other suitable material. The bendability is obtained by a flexible element of the cartridge magazine box. This flexible element may be a slit or a pair of slits of a certain length at the rear wall of the cartridge magazine. Preferred material of the cartridge magazine box for this purpose is suitable polymer or fiber reinforced polymer.

An improved single column cartridge magazine of the present invention optionally also comprises a cartridge guide. This cartridge guide has several functions. One main function of the cartridge guide is to guide the topmost cartridge into the chamber. There are beveled edges on the upper part of the cartridge guide so that the frusto-conical shoulder portion of the cartridge touches the beveled edge when the cartridge is pressed forward by the bolt and the cartridge is guided by these two elements into the chamber. This means that the bullet is not used as a guiding surface or element during the loading movement as it is used in conventional designs. This different guiding principle makes a significant difference. If the bullet is for some reason twisted from its original position during the loading, it may disturb the highly important accuracy of the firearm. Here the term twisted means that the center axis of the cartridge case and the bullet are no longer the same, i.e. coaxial. The cartridge guide together with the stiff but bendable retaining lips ensure a precise positioning of the topmost cartridge in its initial position at the cartridge magazine and through the feeding action until the rear end of the cartridge case loses contact with the retaining lips and beveled edge of the cartridge guide. Also, all the subsequent cartridges in the cartridge magazine remain in one precise position during the loading and also during the recoil. This precise positioning is one of the key elements in reliable cartridge feeding action.

BRIEF DESCRIPTION OF THE DRAWINGS

The nature of the present invention, as well as other objects and advantages thereof, will become more readily apparent from the following description of the disclosed preferred embodiment as shown in the drawings, in which:

FIG. 1A is a side-front view and FIG. 1B is a side-rear view.

DETAILED DESCRIPTION

Figure 1A:
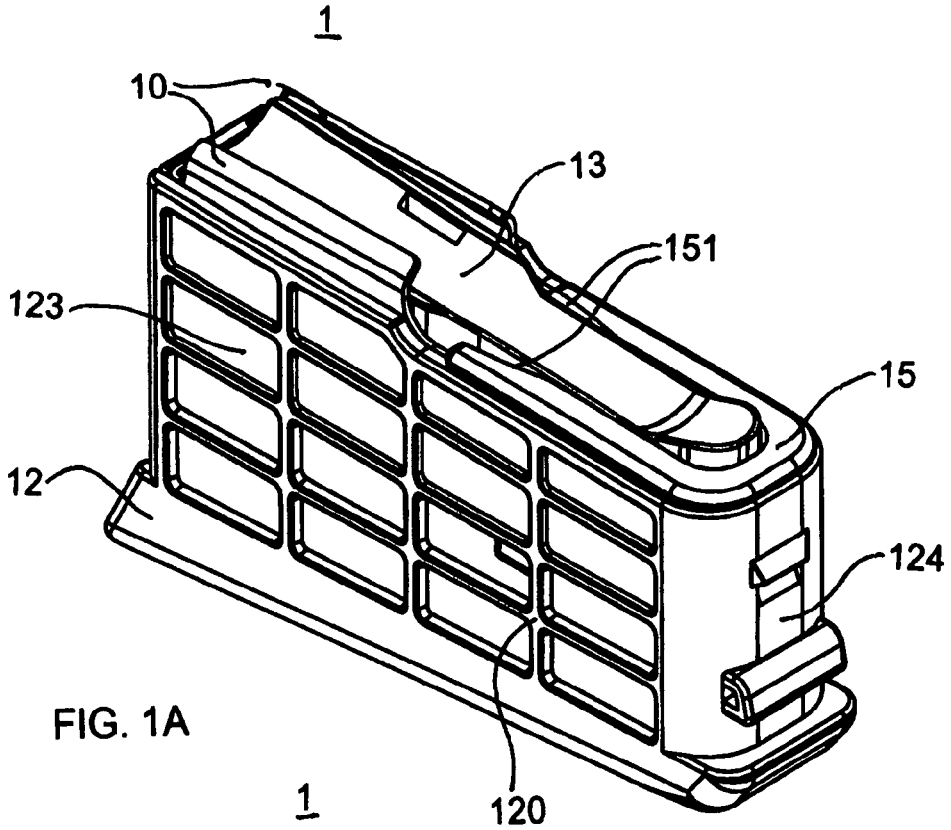
FIGS. 1A and 1B presents a general overview of the cartridge magazine of present invention.
Figure 1B:
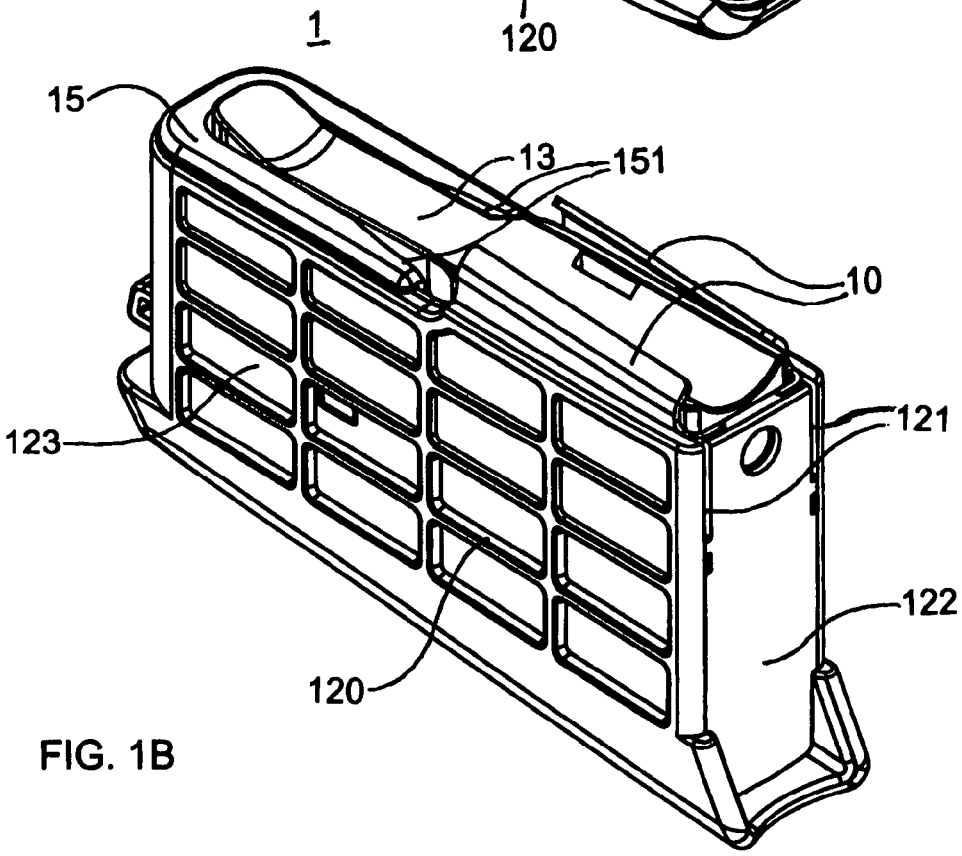

FIGS. 1A and 1B presents a general overview of the cartridge magazine 1 of the present invention. In this figure it is presented the preferred embodiment of the invention. The main elements of the cartridge magazine 1 concerning the invention are a cartridge magazine box 12 having a front wall 124, two side walls 123, a rear wall 122, two retaining lips 10, a cartridge guide 15 and its beveled edges 151. The flexible element 121 is obtained by two slits on the rear wall 122 of the box 12. The box is made of one piece cast plastic and its side walls have ribs 120 to stiffen the construction. Therefore the retaining lips 10 made of steel maintain their original shape but bend just enough to let the cartridge (not shown) be loaded in. A follower 13 is loaded by a spring 14 (not shown in this figure).

Figure 2:
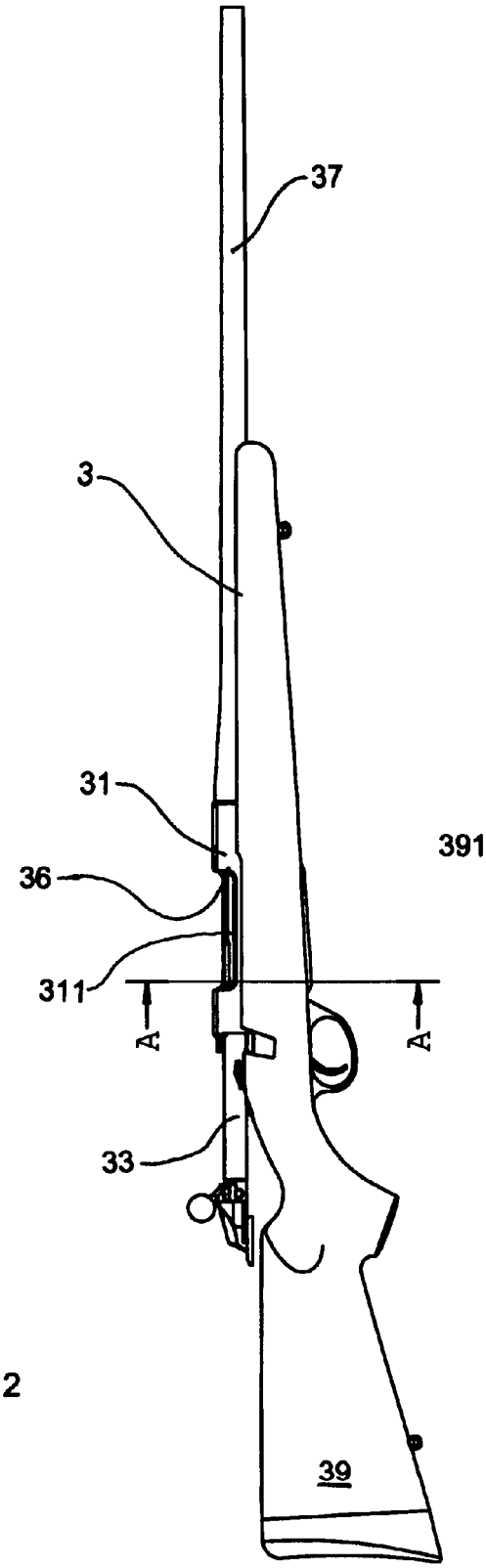
FIG. 2 presents a firearm suitable for applying the present invention.

FIG. 2 presents a suitable firearm 3 for applying the present invention. The firearm 3 may comprise a receiver 31 having an ejection opening 311. For the present invention this ejection opening 311 has at least two purposes: to enable the user to load the cartridge magazine 1 while the cartridge magazine 1 is operatively attached to the firearm 3 and as a second purpose to enable ejection of spent cartridge cases 20 after firing. FIG. 2 also shows a bolt 33 in its open position where the bolt is ready to push a new cartridge to the chamber 36. Other main parts are a barrel 37 and a stock 39. The section markings A-A presents the intersection disclosed in more detail with FIG. 3 and FIG. 4. A cartridge magazine 1 and a magazine opening 391 are not particularly shown on this FIG. 2.

Figure 3:
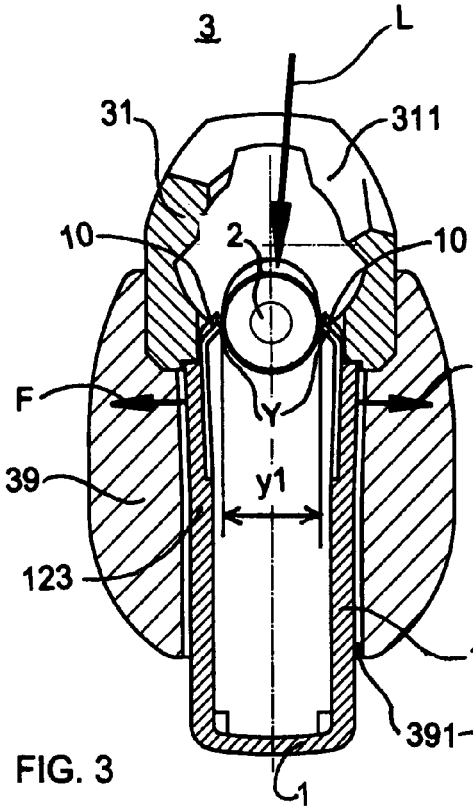
FIG. 3 presents a cross-section of the firearm of FIG. 2 at cross-section A-A, when a topmost cartridge is between the retaining lips.

FIG. 3 presents a cartridge magazine according to the present invention. In this figure it is presented a situation where a user of the firearm 3 is loading a cartridge 2 to the cartridge magazine 1 via the ejection opening 311 of the receiver 31. Said loading or inserting direction/force is illustrated by an arrow L. When the loading force L is applied, the cartridge presses the retaining lips 10 apart from their initial first position X (shown in FIG. 4) to a second position Y. Thus the retaining lips 10 are operatively displaceable from said first position X to said second position Y when a cartridge 2 is being inserted to the cartridge magazine 1 by a user of the firearm 3 while the cartridge magazine 1 is operatively attached to the firearm 3. The cartridge magazine is connected to the firearm 3 through the opening 391 in the stock 39. In said second position Y the distance y1 between the retaining lips 10 is equal to or greater than the diameter of the cartridge case 20. Here the distance y1 means a minimum distance between the corresponding retaining lips 10. The functionality that the side walls 123 are operatively displaceable is illustrated by arrows F.

Figure 4:
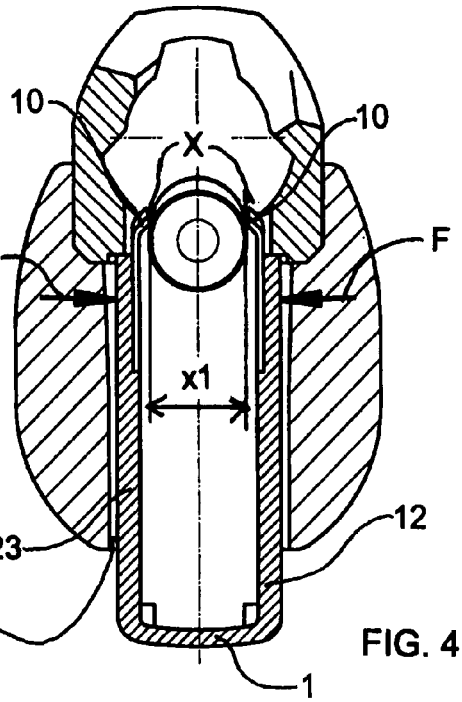
FIG. 4 presents a cross-section of the firearm of FIG. 2 at cross-section A-A, when a topmost cartridge is in a stationary upper position.

FIG. 4 presents a stationary situation after the loading phase of FIG. 3, where in FIG. 4 the topmost cartridge 2 is in an upper position of the cartridge magazine 1. The cartridge 2 has passed the retaining lips 10 and the retaining lips 10 have reversed F to their initial first position X. In said first position X the distance x1 between the retaining lips 10 is less than the diameter of the cartridge case 20. Here the distance x1 means a minimum distance between the corresponding retaining lips 10. The preferred embodiment of this feature is inherent of the plasticity of the cartridge magazine box 12 and its side walls 123 combined together with the flexible element 121 (not shown). The dimensions of the ribs 123, the length of the slit 121 and material properties of the box 12 are designed in this preferred embodiment to set a bending resistance of the retaining lips to a comfortable level so that the spring 14 (shown in FIG. 5) is not able to press the topmost cartridge 2 out of the cartridge magazine and still the user does not find the resistance of inserting cartridges 2 to the cartridge magazine 1 too uncomfortable. Preferably the cartridge magazine box 12 for this purpose is a one piece plastic cast.

Figure 5:
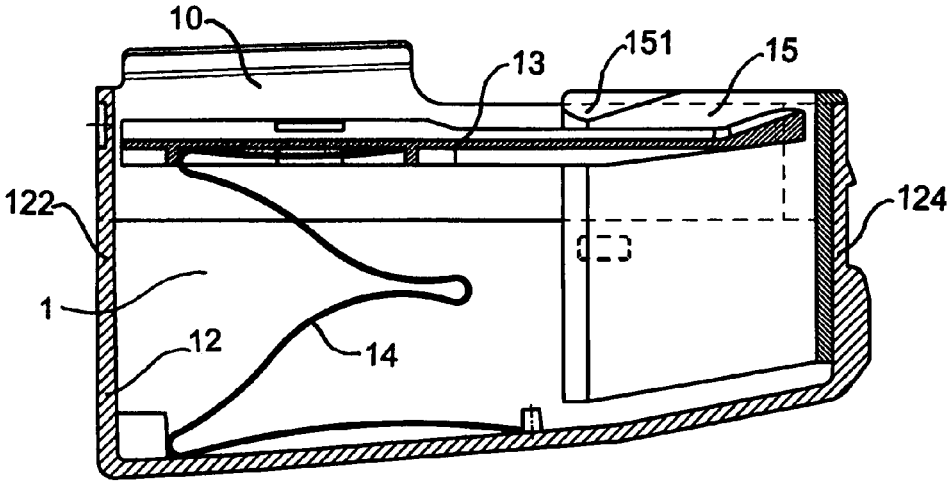
FIG. 5 presents a side cross-section of the cartridge magazine of present invention.

FIG. 5 presents a side cross-section of the cartridge magazine 1 of present invention. The main parts of the cartridge magazine are a retaining lips 10, a box 12 and its rear wall 122 and front wall 124, a follower 13, a spring 14 for pushing the follower and cartridges (not shown) to a upper position, a cartridge guide 15 and its beveled edges 151.

Figure 6:
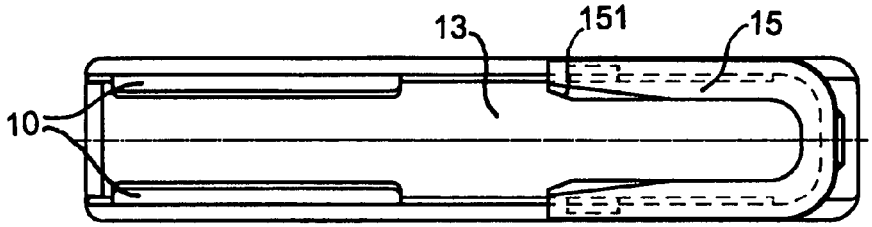
FIG. 6 presents a top view of the cartridge magazine of present invention.

FIG. 6 present a top view of the cartridge magazine 1 of present invention. The parts shown in this FIG. 6 are: retaining lips 10, follower 13, cartridge guide 15 and its beveled edges 151.

Figure 7:
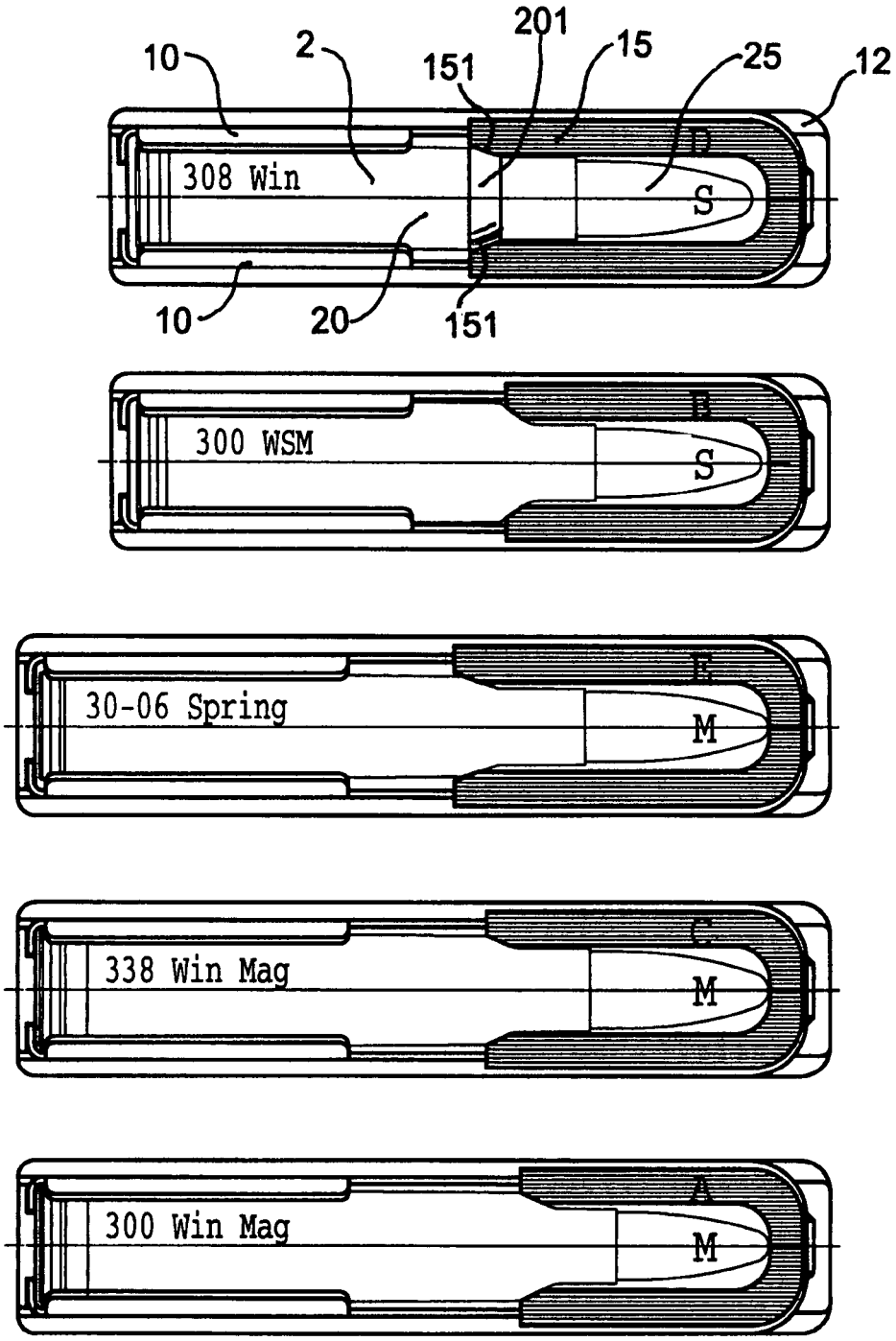
FIG. 7 is a topview of five magazines of two different cartridge magazine box sizes with different cartridge guides to cover five different common cartridges for firearms.

FIG. 7 is a topview of five cartridge magazines of two different cartridge magazine box sizes with different cartridge guides to cover five different common cartridges for firearms. From the economical point of view this is very interesting. It enables a firearm manufacturer to design or select two different cartridge magazine box sizes which covers the whole assortment of commercially interesting and top selling cartridges.

However, the interest is not only from the economical side, but also this brings a clear technical advantage over the common way of guiding a cartridge 2 to the chamber 36 of the firearm 3. According to one embodiment of the present invention, the retaining lips 10 are operatively displaceable from said first position X to said second position Y when a cartridge 2 is loaded from the cartridge magazine to the chamber 36 by the bolt 33 of the firearm 3 while the cartridge magazine 1 is operatively attached to the firearm 3. This enables an improved way to guide a cartridge 2 to the chamber 36. Indeed, the cartridge magazine may further comprise a cartridge guide 15 for steering the cartridge 2 from the cartridge magazine 1 to the chamber 36. For this purpose the cartridge guide 15 may have beveled edges 151 to form a mating surface to be in guiding contact with a frusto-conical shoulder portion 201 of the cartridge case 20 and therefore the bullet 25 is not used as a guiding surface. This combination of operatively displaceable retaining lips 10 and cartridge guide 15 results in a very smooth and reliable feeding action where the bolt 33 is gently pushing the cartridge 2 to the chamber 36.

FIG. 7 shows the idea that the cartridge guide 15 is an interchangeable part of the cartridge magazine. With slight modifications in dimensions, the cartridge guide 15 is adapted to fit the dimensions of the cartridge 2. When a cartridge magazine is used for hunting purposes, the user appreciates silent equipment. When the cartridge guide 15 is adapted to minimize the loose space between the cartridge 2 and the cartridge magazine box 12, it reduces the possible noise of cartridges 2 clicking toward the cartridge magazine box 12 to a minimum. It also helps in the objective of the invention to build a very reliable feeding action to the firearm, such as a bolt action rifle, because the cartridges 2 in the cartridge magazine are located in constant positions. In one of the preferred embodiments here, the cartridge guide 15 is adapted to offset the cartridges 2 in the cartridge magazine 1 to a position where the offset in a axial direction of the cartridges 2 is less than ⅛" (approx. 3 mm).

One further embodiment of the invention is the material selection for the cartridge guide 15. It is an advantage, if the cartridge case 20 does not "stick" to the cartridge guide 15. Therefore the friction between these two elements should be as low as possible. The inventor has found, that the preferred embodiment is a cartridge guide 15 made from a plastic material having a low friction coefficient, i.e. less than 0.3 with brass. As it is well-known in this field of technology, the majority of cartridge cases are manufactured of brass.

INDUSTRIAL APPLICABILITY

This invention is applicable to cartridge magazines to be sold together with a firearm such as rifles, bolt action or semi-automatic rifles, pistols, other firearms, etc. or as a after-market or sparepart cartridge magazine. Since the best mode of carrying out the invention is adapted for cartridges with frusto-conical shoulder portion, the majority of applications lie in the field of centerfire rifles.

It will be understood that the foregoing relates only to a disclosed preferred embodiment(s) of the present invention, and that numerous alterations and modifications may be made therein without departing from the spirit and the scope of the invention as defined in the following claims.

LIST OF REFERENCE NUMBERS IN FIGURES

1 cartridge magazine
10 retaining lips
X first position of retaining lips
x1 distance between the retaining lips 10 in a first position X
Y second position of retaining lips
y1 distance between the retaining lips 10 in a second position Y
L loading or inserting force/direction
12 cartridge magazine box
120 ribs
121 flexible element, slit
122 rear wall
123 side wall
F flexibility of the side walls 123
124 front wall
13 follower
14 spring
15 cartridge guide
151 beveled edges
2 cartridge
20 cartridge case
201 frusto-conical shoulder portion
25 bullet
3 firearm
31 receiver
311 ejection opening of the receiver
33 bolt
36 chamber
37 barrel
39 stock
391 magazine opening

What is claimed is:

1. A cartridge magazine comprising:

a cartridge magazine box configured to form a housing of the cartridge magazine, the housing having an elongated channel configured to receive a plurality of cartridges in a single column, the cartridge magazine box formed from plastic so as to have inherent plasticity, a pair of retaining lips positioned on the housing, the retaining lips formed from a stiff metal, a follower operated by a spring, the follower configured to press a plurality of cartridges in the cartridge magazine to an upper position so that when in said upper position the topmost cartridge is ready for feeding into a chamber of a firearm and in said upper position the topmost cartridge rests against said pair of retaining lips, said retaining lips configured in cooperative engagement with said cartridge magazine box with its inherent plasticity so as to remain in a first position when the topmost cartridge is in the upper position, and configured to be operatively displaceable to a second position wider than the first position, wherein in said first position the distance between the retaining lips is less than the diameter of a cartridge case of said plurality of cartridges.

2. The cartridge magazine according to claim 1, wherein in said second position the distance between the retaining lips is equal to or greater than the diameter of a cartridge case of said plurality of cartridges.

3. The cartridge magazine according to claim 1, wherein the retaining lips are dimensioned to be operatively displaceable from said first position to said second position when a cartridge of said plurality of cartridges is being inserted to the cartridge magazine by a user of the firearm while the cartridge magazine is operatively attached to the firearm.

4. The cartridge magazine according to claim 1, wherein the retaining lips are dimensioned to be operatively displaceable from said first position to said second position when a cartridge is loaded from the cartridge magazine to the chamber by a bolt of the firearm while the cartridge magazine is operatively attached to the firearm.

5. The cartridge magazine according to claim 1 further comprising a cartridge guide for steering a cartridge of said plurality of cartridges from the cartridge magazine to the chamber of the firearm.

6. The cartridge magazine according to claim 5, wherein the cartridge guide has beveled edges to form a mating surface to be in guiding contact with a frusto-conical shoulder portion of the cartridge case.

7. The cartridge magazine according to claim 5, wherein the cartridge guide is an interchangeable part of the cartridge magazine.

8. The cartridge magazine according to claim 5, wherein the cartridge guide is adapted to fit the dimensions of a cartridge of said plurality of cartridges.

9. The cartridge magazine according to claim 8, wherein the cartridge guide is adapted to minimize loose space between the cartridge and the cartridge magazine box.

10. The cartridge magazine according to claim 8, wherein the cartridge guide is adapted to offset the cartridges in the cartridge magazine to a position where the offset in an axial direction of the cartridges is less than approximately ⅛" (3 mm).

11. The cartridge magazine according to claim 8, wherein the cartridge guide is of plastic material having a low friction coefficient with brass.

12. The cartridge magazine according to claim 11, wherein said friction coefficient is less than 0.3.

13. The cartridge magazine according to claim 1, wherein the cartridge magazine box comprises ribs in side walls of the cartridge magazine box.

14. The cartridge magazine according to claim 13, wherein the dimensions of the ribs, a length of a slit in the cartridge magazine box and material properties of the cartridge magazine box are designed to set a bending resistance of the retaining lips to a level so that the spring is not able to press the topmost cartridge out of the cartridge magazine and still allow a user to not find the resistance of inserting cartridges to the cartridge magazine uncomfortable.

* * * * *